United States Patent [19]

Wu

[11] Patent Number: 5,050,495

[45] Date of Patent: Sep. 24, 1991

[54] PRINT WHEEL SETTING MECHANISM

[76] Inventor: Sheng J. Wu, P.O. Box 1-79, Taipei, Taiwan

[21] Appl. No.: 347,863

[22] Filed: May 5, 1989

[51] Int. Cl.[5] ..... B41L 47/46

[52] U.S. Cl. ..... 101/91; 101/110

[58] Field of Search ..... 101/91, 110, 95, 99, 101/100

[56] References Cited

U.S. PATENT DOCUMENTS

| | | | |
|---|---|---|---|
| 1,185,667 | 6/1916 | Hoe | 101/366 |
| 3,965,815 | 6/1976 | Lupkas et al. | 101/91 |
| 4,034,669 | 7/1977 | Freeman | 101/91 |
| 4,398,458 | 8/1983 | Denzin | 101/91 |
| 4,520,725 | 6/1985 | Haug | 101/91 |
| 4,552,065 | 11/1985 | Billington | 101/91 |
| 4,580,493 | 4/1986 | Sette | 101/91 |
| 4,603,627 | 8/1986 | Pollak | 101/91 |
| 4,604,950 | 8/1986 | Sette | 101/91 |
| 4,608,923 | 9/1986 | Muller | 101/91 |
| 4,636,959 | 1/1987 | Salazar | 101/91 |
| 4,759,283 | 7/1988 | Gilham | 101/110 |

*Primary Examiner*—David A. Wiecking
*Assistant Examiner*—Steven S. Kelley
*Attorney, Agent, or Firm*—Lalos & Keegan

[57] ABSTRACT

An improved digital mark-printer operated under control of a microprocessor and control program. A main shaft including a printing head with a plurality of numeral wheels is driven by drive circuits and the position of the shaft and wheels are sensed by sensor circuits, all under control of the microprocessor.

22 Claims, 12 Drawing Sheets

PRINT WHEEL SETTING MECHANISM

BACKGROUND OF THE INVENTION

The present invention relates to a digital mark-printer, and more particularly relates to a printer controlled by stored program within a microprocessor system and that automatically and programmably performs the function of printing a variety of marks, such as postmarks used in the postal office.

Similar printing functions are disclosed in U.S. Pat. No. 3,965,815, wherein a mechanism for sequentially setting the print wheels in a postage printing device is described. The setting mechanism is electrically controlled to interface the postage printing device with a computerized or electronic postage system. The setting mechanism comprises a main rotatable driving gear which is slidable upon a splined shaft so as to individually, operatively engage a plurality of print wheel driving racks in a sequential fashion. A setting linkage connected to the main driving gear positions the gear into individual engagement with a plurality of rotatable shafts individually driving each of the print wheel driving racks. A stepper motor is connected to the splined shaft, which in turn rotatably drives the main drive gear. The setting linkage is actuated by means of a pair of solenoids.

However, such device has a drawback. Due to its inherent spatial limitation, only a single pair of solenoids 60, 70 can be arranged in the device which permits control of only four driving racks 43*a*, 43*b*, 43*c* and 43*d*, thus making only four marks available. However, there must be at least five changeable marks in a postmark in order to automate postmark printing, thus making this device impractical.

SUMMARY OF THE INVENTION

A primary object of the present invention is to provide a fully automatic mark-changeable printer which through control of stored program in a micro-processor system can print a date mark, cost mark, etc. with more print marks available than in the prior art.

A further object of the present invention is to provide an electro-mechanically integrated, fully automatic digital mark-printer system which is computerized so that it can cooperate with other peripheral equipment to provide an unmanned fully automatic system for use in business.

The above and other objects and advantages of the present invention will become apparent from the following description with reference to the accompanying drawings.

BRIEF DESCRIPTION OF THE DRAWINGS

FIG. 8A showing a ready state, FIG. 8B showing a printing state;

DETAILED DESCRIPTION OF THE PREFERRED EMBODIMENT

Figure 1:
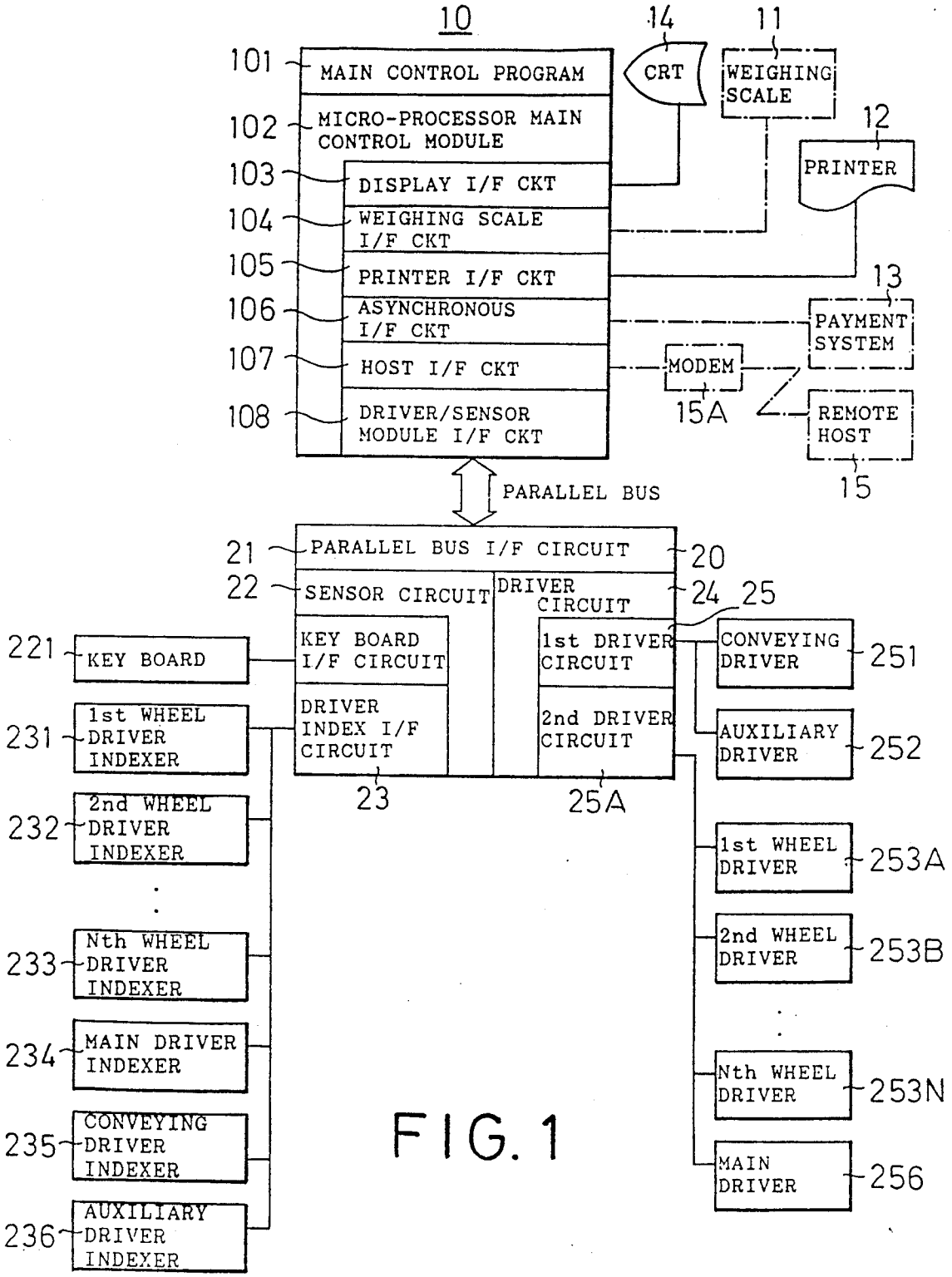
FIG. 1 is a block diagram of a digital mark-printer in accordance with the present invention.

Referring to FIG. 1, a central processing unit (abbreviated as CPU hereinafter) 10 basically comprises a main control program 101, a microprocessor main control module 102, a display interface circuit 103 connected to a monitor 14, a printer interface circuit 105 connected to a printer 12. In practice, if necessary, it may further comprise a weighing scale interface circuit 104 connected to a weighing scale 11, an asynchronous interface circuit 106 connected to a payment system 13, a host interface circuit 107 connected to a modem 15A as well as a remote host 15, and a driver/sensor module interface circuit 108. The CPU 10 is electrically connected to a parallel bus interface circuit 20 through a parallel bus. The parallel bus interface circuit 20 comprises a sensor circuit 21 and a driver circuit 24. The sensor circuit 20 includes keyboard interface circuit 22 connected to a keyboard 221 and a driver index interface circuit 23. The driver circuit 24 includes a first driver circuit 25, connected to a conveying driver 251 and an auxiliary driver 252, and a second driver circuit 25A. The second driver circuit 25A is electrically connected to a main driver 256, a first wheel driver 253A, a second wheel driver 253B, . . . and a Nth wheel driver 253N. The driver index interface circuit 23 is electrically connected to a first wheel driver indexer 231, a second wheel driver indexer 232, an Nth wheel driver indexer 233, etc., a main driver indexer 234, a conveying driver indexer 235 and an auxiliary driver indexer 236.

The following is a description of a preferred embodiment of this invention. For the purpose of understanding the operation of the present invention, postal material will be processed, as an example, by the system of the present invention.

When postal material is disposed on an electronic weighing scale 11 before entering the system of this invention, its weight can be displayed on the screen of the CRT 14 by the CPU 10. In the meantime, the CPU 10 can accept instructions input from the keyboard 221 through the keyboard interface circuit 22. The CPU 10 then calculates the proper postage based on the available data and displays it on the screen of the CRT 14. The customer can then pay for the postage by inserting a specially-designed card in the payment system 13 or by some other device for inserting coins, whereby the CPU 10 will actuate the first driver circuit 25 and the second driver circuit 25A through the driver circuit 24, and consequently activate the conveying driver 251 and auxiliary driver 252 to move and bring the postal material to a proper position for printing. At this moment, the wheel drivers 253A, 253B, . . . 253N are also actuated and rotate their respective numerical wheels. The CPU 10 instructs each of the wheel drivers to rotate a certain angle in cooperation with the data from the respective wheel driver indexer 231, 232, 233, etc., until each desired number is respectively attained and then the CPU 10 activates the first driver circuit 25 and second driver circuit 25A thereby rotating the main driver 256 and postmarking and imprinting the date and postage on the postal material. Furthermore, the main driver 256 is restored to its home position for the next working cycle by sensing the main driver indexer 234.

Figure 2:
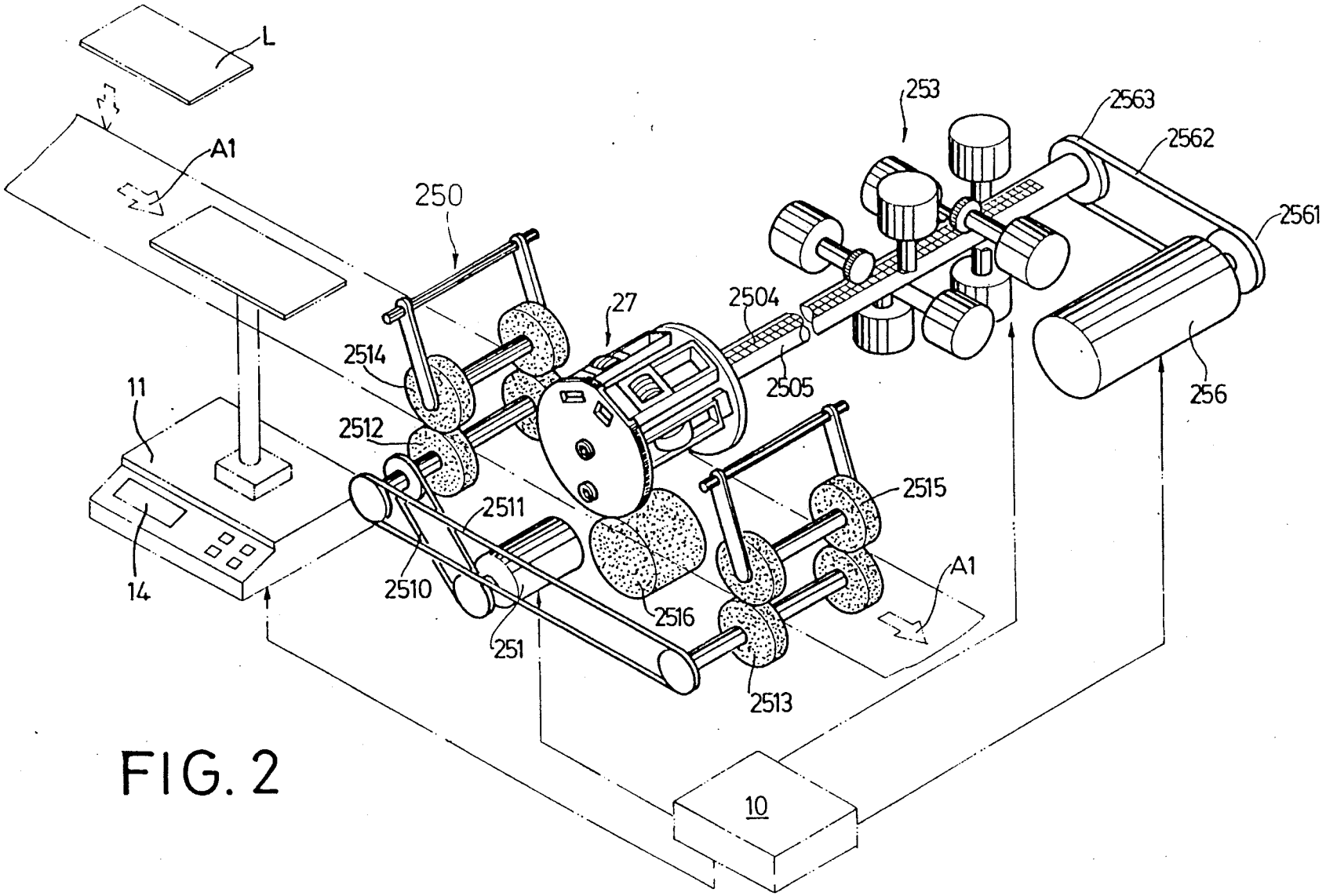
FIG. 2 is a perspective view of the overall digital mark-printer of an embodiment in accordance with the present invention.
Figure 3:
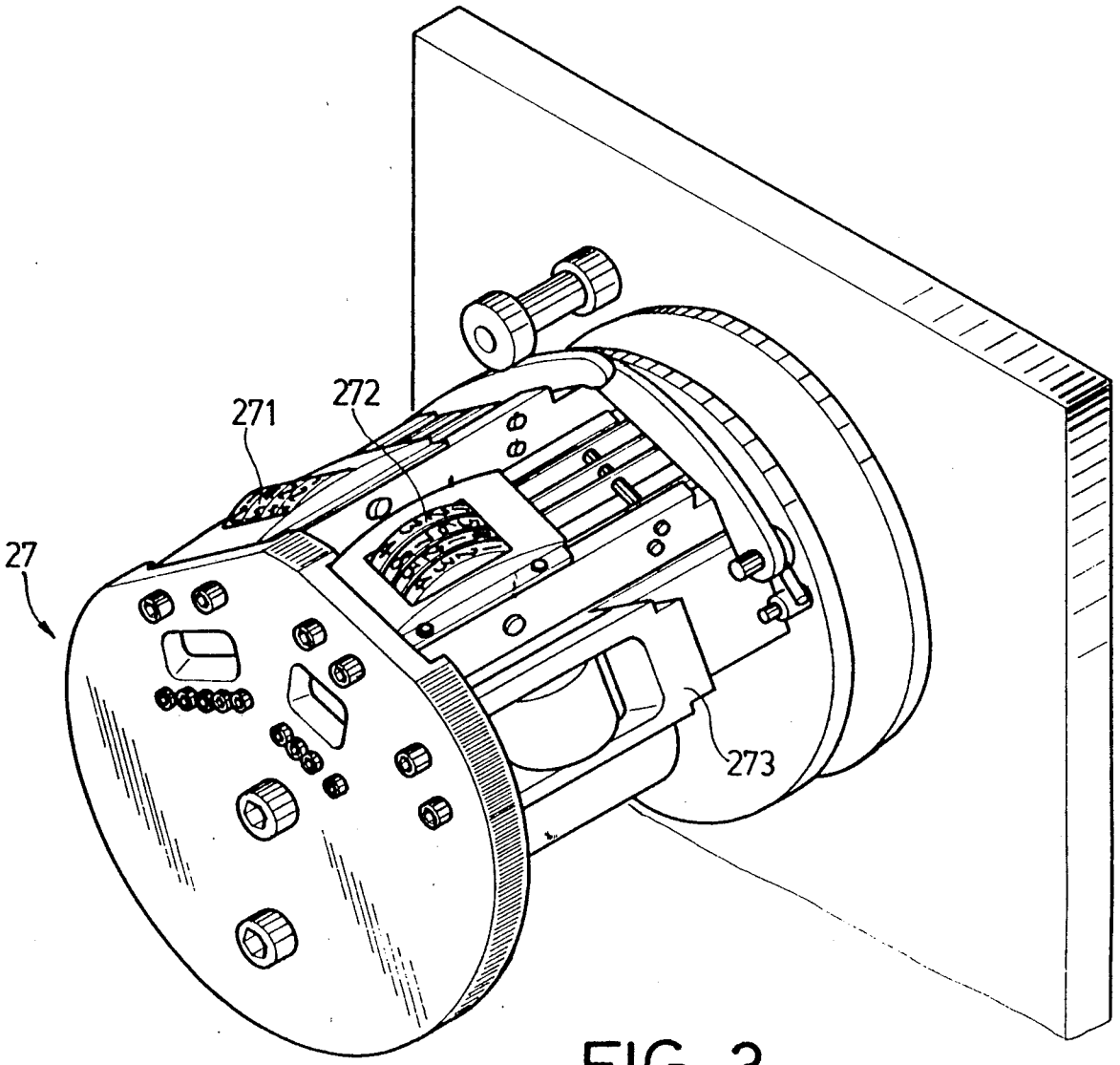
FIG. 3 is a perspective view of a roller printing head of an embodiment in accordance with the present invention.
Figure 4:
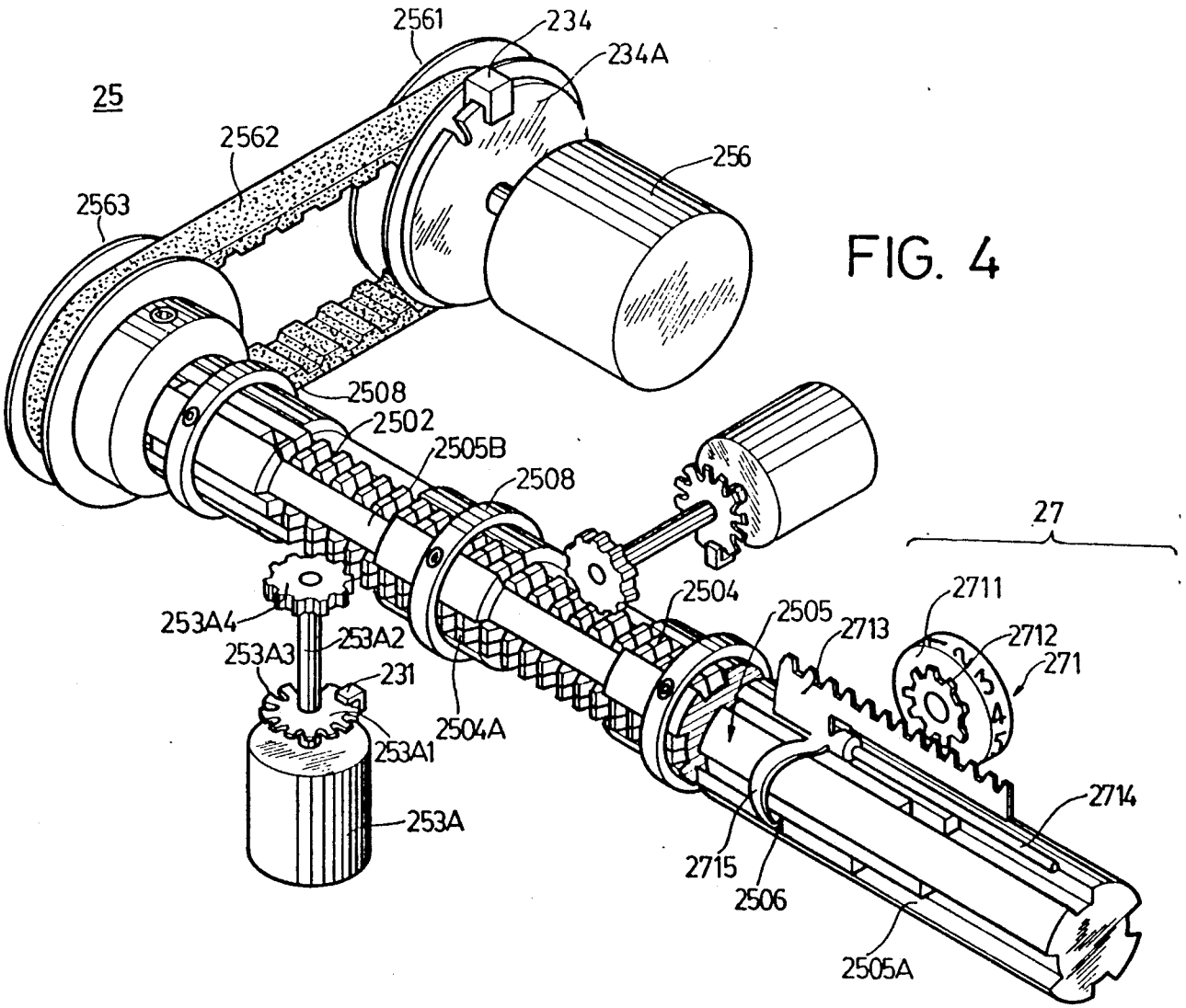
FIG. 4 is a perspective view of the settable mechanism of the roller printing head according to FIG. 2 wherein for clarity, only one numerical wheel set with its respective driver is shown.
Figure 8A:
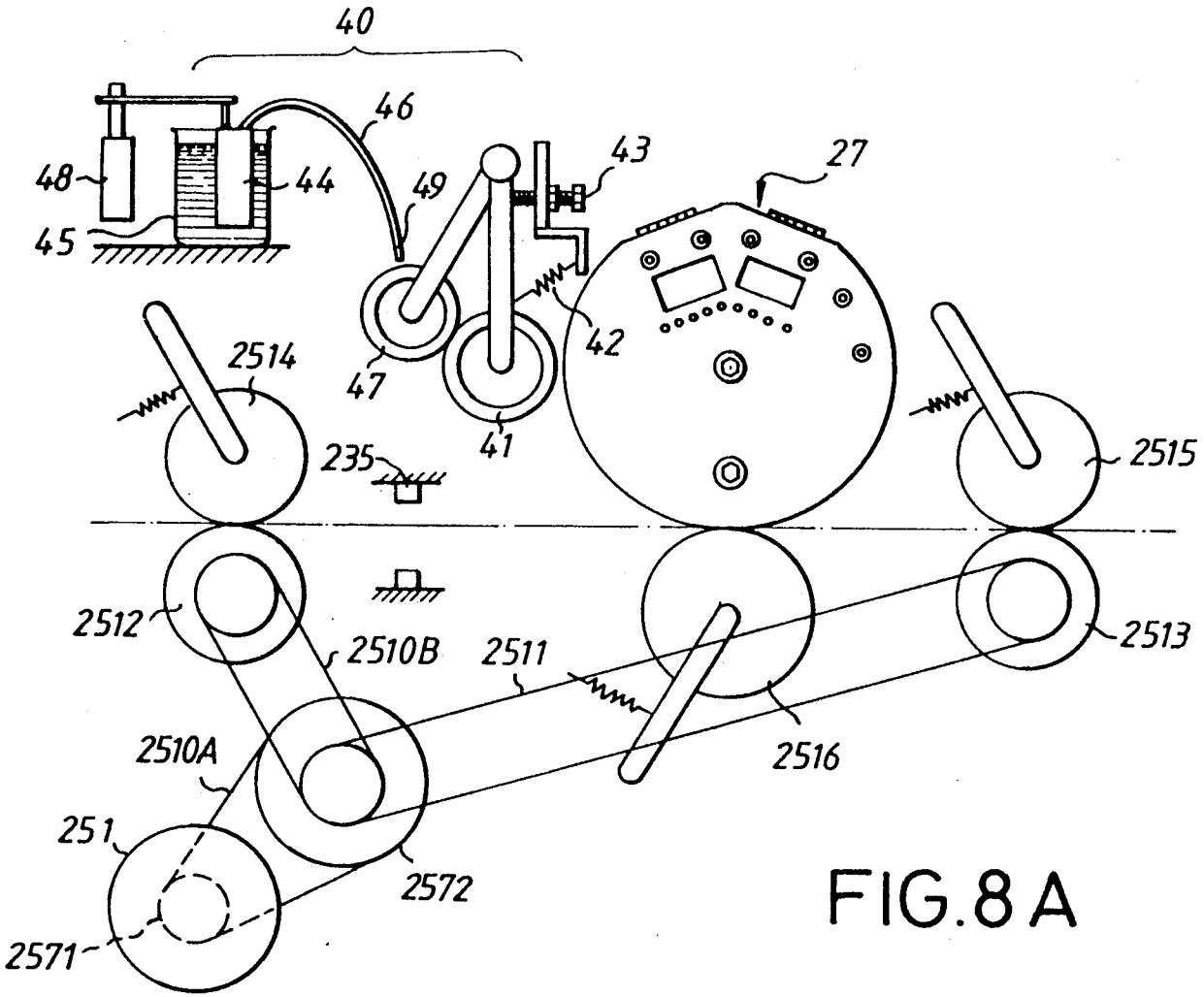
FIGS. 8A and 8B are side elevational views of the present invention.
Figure 8B:
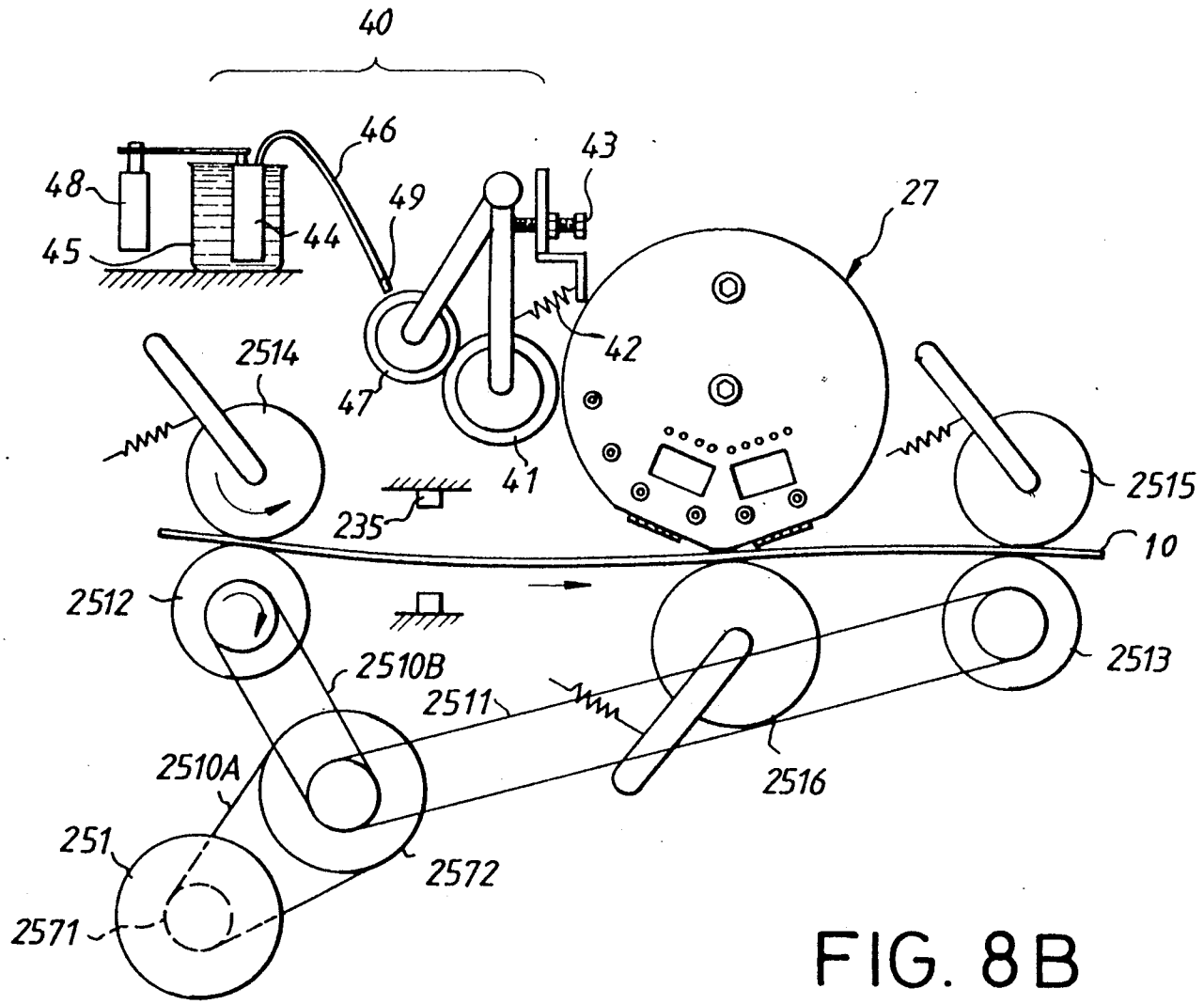

Turning now to FIG. 2, a first embodiment of this invention is shown. The device includes a conveying system 250 and a postmark printing system 27 wherein the conveying system 250 is arranged above and below a conveying reference surface A1, including a main driving means of the conveying system, for example a stepper motor 251 driving a first roller 2512 and a second roller 2513 through timing belts 2510 and 2511 respectively. Referring to FIGS. 8A and 8B, installed is an idle roller 2514 with a stretching spring above the first roller 2512, and an idle roller 2515 above the second roller 2513. The postmark printing system is shown in FIGS. 3 and 4, including a main shaft driving means, e.g. second stepper motor 256, pulleys 2561, 2563, a timing belt 2562, a main shaft 2505, on which a plurality of second racks 2504 are slidably mounted, a plurality of stepper motors 253A, . . . 253N for driving their respective numeral wheels 271, 272 through their respective related gears 2534A . . . 253N4, ink-printing means 40, a printing head 27, and an idle roller 2516 thereof (see FIGS. 2, 3, 4, 8A and 8B). The printing head 27, as seen in FIG. 3, includes a postmark wheel means 271 for imprinting postage, a postmark wheel means 272 for imprinting accepted date, and a graphical postmark means 273 for imprinting advertising marks.

Referring to FIG. 4, the postmark wheel means 271 further comprises a numeral wheel 2711, a gear 2712 attached therewith, a first rack 2713 engaged with the gear 2712, a guiding bar 2714 for the rack 2713 to move thereon, and a hooking arm 2715. The lower end of the hooking arm is secured to a recess 2506 of a second rack 2504. In order to restore the main shaft 2505 to its home position after the completion of postmarking, an encoder 234A and a main driver indexer 234 are disposed near the driving portion of the second stepper motor 256. Similarly, in order to assure that the stepper motor 253A properly drives the corresponding character wheel 2711, an encoder 253A1 and a first wheel driver indexer 231 are disposed thereon.

Prior to the entering of postal material into the conveying system, the printing head 27 is zeroed to its home position (not shown) wherein a motor 251 is the prime driving source of the conveying system. As shown in FIGS. 8A and 8B, disposed between the first roller 2512 and printing head 27 is a phototransistor conveying driver indexer 235 whereby after postal material 10 passes through the indexer 235, the CPU 10 will actuate the printing head 27. Below the printing head 27 is a third idle wheel 2516 with stretching spring in order that the postal material 10 be in close contact with the numeral wheel 271 of the printing head 27, as shown in FIG. 8B.

As to the ink applied to the numeral wheel 271, it will be applied by a printing ink means 40, as shown in FIGS. 8A and 8B. An ink wheel 41 is secured to a spring 42 and kept apart for a small gap from the printing head 27 by an adjusting screw 43 so that only when the protruding part of the numeral wheel passes by will the ink wheel 41 have proper contact therewith. During each cycle of operation, the printing head 27 will, driven by a solenoid 48 and a pump 44, cause the ink wheel 41 to be provided with suitable amount of ink.

As can be seen in FIG. 8B, when the postal material 10 is advanced to be printed by the printing head 27, due to the spring effect of the first, second, and third idle wheels 2514, 2515, 2516, the printing effect is equal regardless of the thickness of the printed postal material. This is an advantage of the present invention over prior art.

Figure 5:
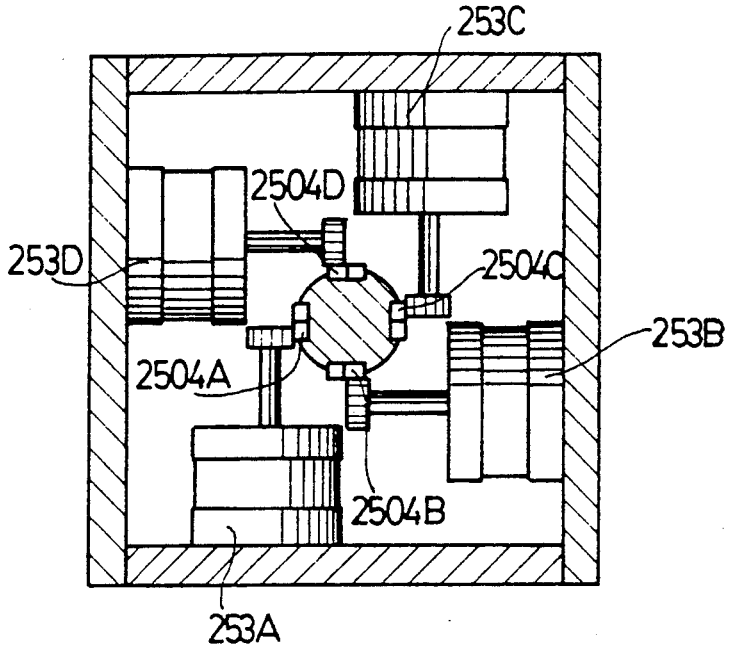
FIGS. 5 to 7 are cross-sectional views of different arrangements of a wheel driver for eight, ten, twelve numeral wheels according to FIG. 2.
Figure 6:
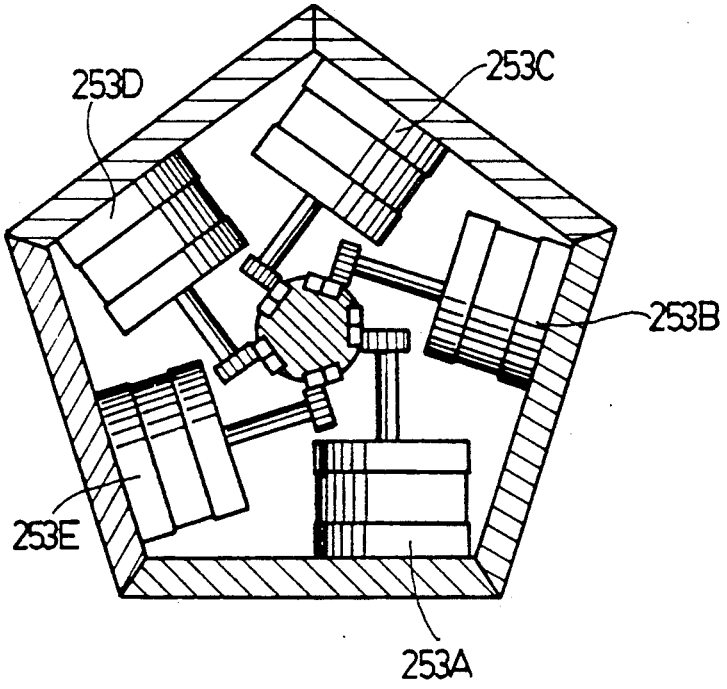
Figure 7:
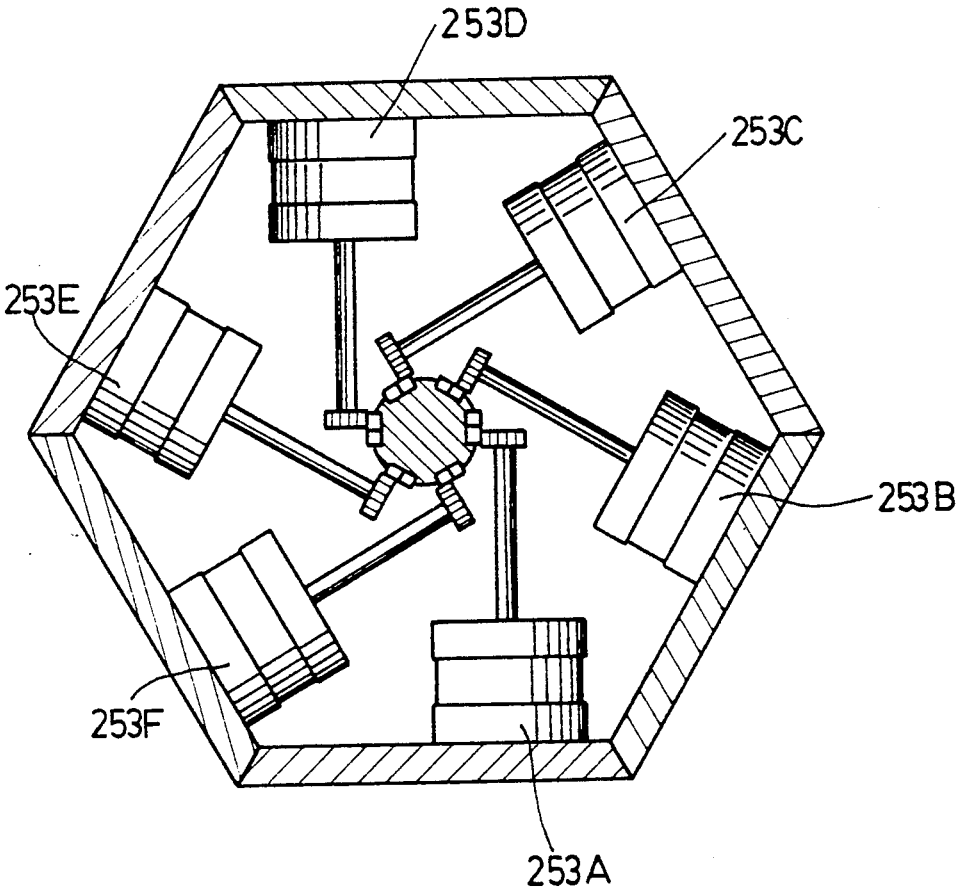

The disclosure thus far is related only to a printing head with one numeral wheel. In practical operation, however, the device works with four numeral wheels, or more than four numeral wheels arranged as two or more parallel sets, wherein one set functions as date numeral wheel, and the other as postal charge numeral wheel, as shown in FIGS. 2 and 3. Various arrangements between a plurality of stepper motors 253A–253F and their related second racks 2504A–2504F for each set of character wheels are shown in FIGS. 5, 6 and 7, respectively. As seen from FIG. 5, four stepper motors 253A–253D are disposed within a square frame. Two sets in this arrangement will drive eight numeral wheels 271. Similarly, ten character wheels and twelve character wheels may also be driven by a pair of five and six stepper motors arranged as illustrated in FIGS. 6 and 7, respectively. As can be understood, more character wheels can be arranged as necessary.

A relatively smaller diameter portion 2505B of the main shaft 2505 of the printing head is located near the driving gear 253A4, as shown in FIG. 4. As will be seen from the drawing, the outer perimeter of the relatively smaller diameter portion 2505B, comes flush with the dented base 2502 of the second rack 2504, so that after respective stepper motors 253A–253N are located at their proper positions and the main shaft 2505 of the printing head rotates, the second racks 2504 and the relatively smaller diameter portions 2505B can slip through the driving gear 253A4. In other words, the second rack 2504 for driving the character wheels of the printing head 27 can slide axially along the main shaft 2505, and also can rotate together with the main shaft 2505 after reaching its proper position, thus easing the work of the printing head 27 and reducing the very complicated mechanism needed in the prior art. This is a further important advantage of the present invention.

Figure 9:
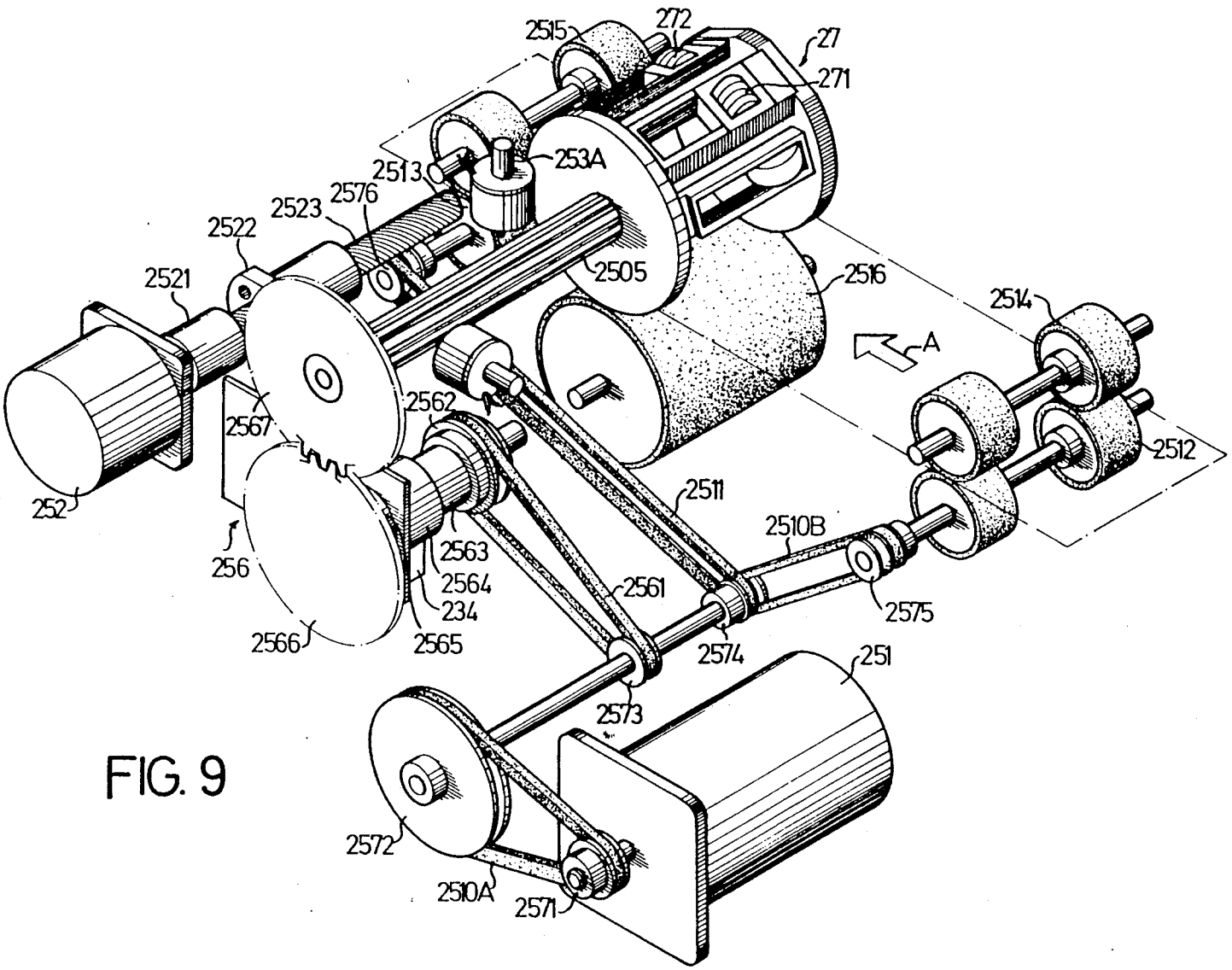
FIG. 9 is a perspective view of the digital mark-printer of another embodiment of the present invention.
Figure 10:
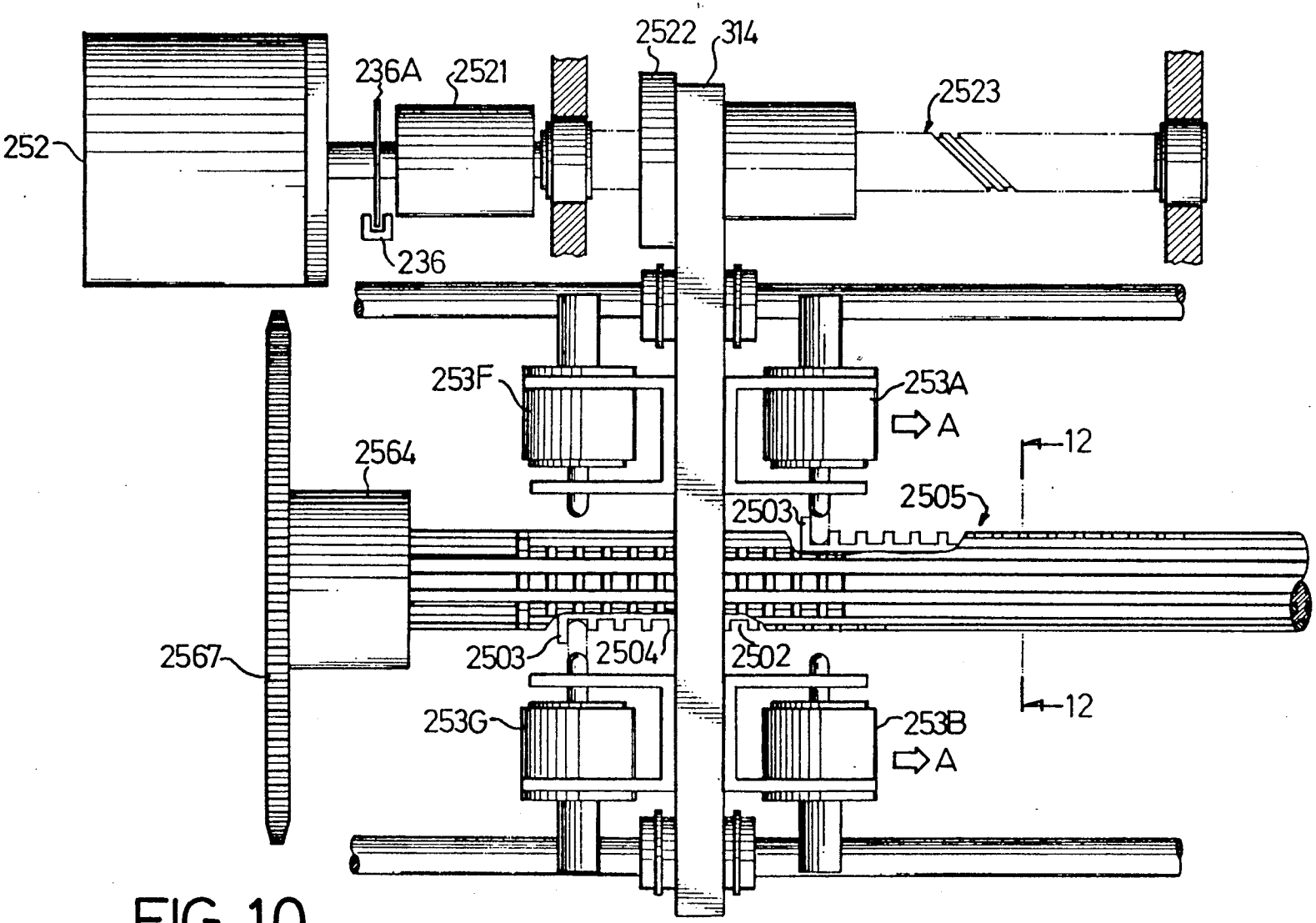
FIG. 10 shows a plan view of main shaft and numeral wheel driving system according to FIG. 9.
Figure 11:
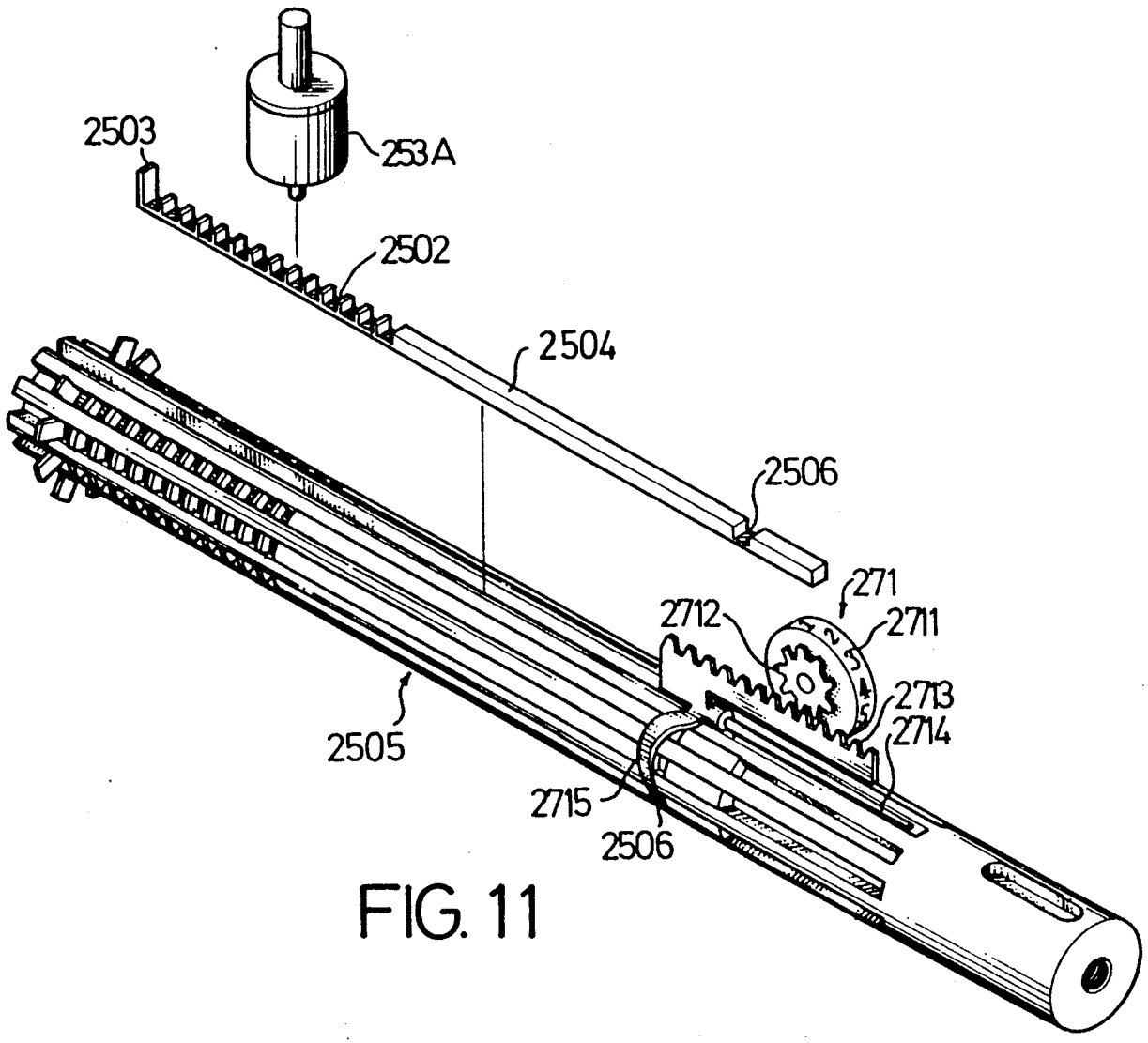
FIG. 11 is a partially exploded perspective view of the settable mechanism of the roller printing head in accordance with FIG. 9.
Figure 12:
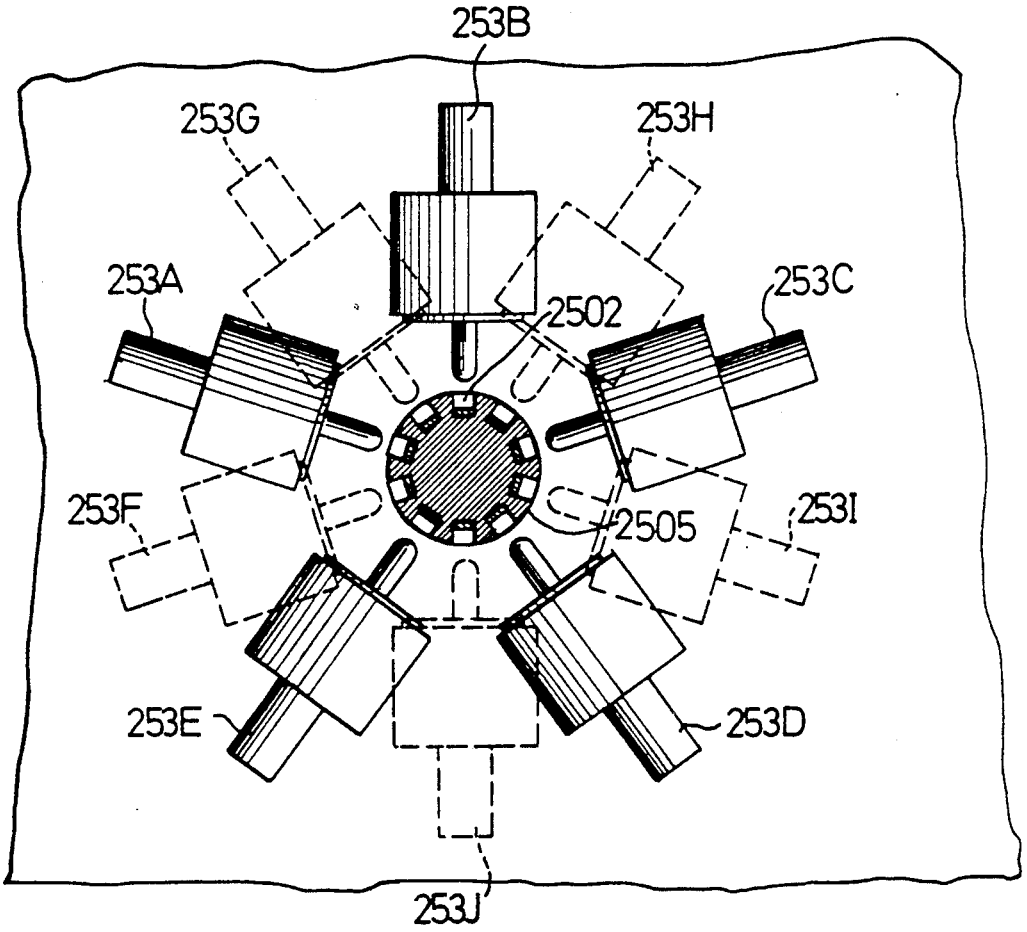
FIG. 12 is a cross-sectional view taken on line 12—12 in FIG. 10.

Another embodiment of the present invention is shown in FIGS. 9 to 12. The numeral wheel driving means includes a stepper motor 252 and a coupler shaft 2521, the coupler shaft 2521 connecting the stepper motor 252 to a screw rod 2523 to make the screw rod 2523 rotate together with the stepper motor 252. A screw block 2522 is rotatably mounted on the screw rod 2523, and a solenoid seat 314 is further installed on the screw block 2522 (as shown in FIG. 10). Numeral wheel drivers 253A–253N are disposed on both sides of the solenoid seat 314. The numeral wheel drivers are plural solenoids 253A, 253B, . . . 253N which can extend or retract their piston rod according to commands from CPU to engage with or disengage from the second racks 2504 for setting the corresponding numeral wheels 271A, 271B, . . . 271N (as shown in FIGS. 9, 10 and 12).

As shown in FIG. 10, when driving means driving circuit 25 activates the stepper motor 252 to rotate clockwise, urging the solenoid seat 314 to move forward (as indicated by arrow A), the solenoid 253N will extend its piston rod into dents 2502 of the second rack 2504 in proper position thus moving the second rack 2504 forward until it is signaled to stop by a CPU pulse signal. Therefore, the numeral wheel 271N is rotated to a desired numeral position. For example, when "2" is the desired numeral in numeral wheel 271, the solenoid 253A will keep its shaft pin in a retracted state and move together with the solenoid seat 314. When it reaches the 11th dent 2502 of the second rack 2504, the solenoid 253A will now extend its piston rod into the 11th dent, urging the second rack 2504 to drive the numeral wheel 271 from "1" to "2". Other numeral positions can be acquired in a similar manner.

The numeral wheel can be driven in another manner. When "2" is the desired numeral, the solenoid 253A can extend its piston rod into the first dent 2502 of the second rack 2504 at the beginning, and then move together with the solenoid seat 314 to make the second rack 2504 move forward. When the solenoid 253A moves to the original position of the second dent, it then retracts its piston rod and stays that way until the end position. Therefore, the numeral wheel 271 is driven from "1" to "2" by the second rack 2504. Other numerals can be achieved by a similar way.

In reverse, when the numeral wheel 271 is to return to its original position, the solenoids 253 all retract their piston rods and the stepper motor 252 rotates counterclockwise to move the solenoid seat 314 back to the home position, whereby the solenoid 253 can urge against the projections 2503 at the end of the second racks 2504 to bring the second racks 2504 as well as all numeral wheels back to their home positions for next working cycle.

Referring to FIG. 9, a coaxial pulley 2573 is disposed between the pulleys 2572 and 2574, whereby through pulleys 2571, 2572, 2573 and belts 2510A, 2561, the motor 251 of the conveying means can drive the shaft 2563 of the brake clutch 2564 of the main shaft driving means 256.

When postal material 10 moves through a location sensing means (not shown), the solenoid 234 of the brake clutch 2564 (see FIG. 9) is activated to rotate the shaft 2565 of the brake clutch 2564 for one turn and stop the shaft 2565 in its original position. Accordingly, the driving gear 2566 to which the shaft 2565 connects rotates and urges another driving gear 2567 to rotate. As a result, through the shaft 2565, the printing head 27 is rotated for one turn and stopped where it was, whereby the postal material is imprinted between the printing head 27 and the idle roller 2516 disposed thereunder and carried away by conveying pulley 2513 and idle roller 2515. Then, the motor 251 of the conveying means is instructed to stop.

As various possible embodiments might be made without departing from the scope of the invention, it is to be understood that all matter herein described or shown in the accompanying drawings is to be interpreted as illustrative and not in a limiting sense.

I claim:

1. A digital mark-printer comprising:

a printing head;

a main shaft for supporting said printing head;

a main shaft driver means connected to said main shaft for rotatably driving said main shaft;

a plurality of wheel means disposed on an outer surface portion of said printing head;

a plurality of wheel driver means each individually connected to a respective one of said plurality of wheel means to individually drive each one of said wheel means, whereby said plurality of wheel means can be driven simultaneously;

a central processing unit connected to said main shaft driver means for controlling said main shaft driver means and to said plurality of wheel drivers means for controlling said plurality of wheel driver means;

a plurality of gears, one each attached to a respective one of said plurality of wheels;

a plurality of first racks, one each arranged for cooperative engagement with a respective one of said plurality of gears;

a plurality of second racks, each of said second racks having a first end for cooperative engagement with and for being driven by a respective one of said wheel driver means, and a second end longitudinally displaced from said first end;

each of said plurality of first racks including an arcuate hook arm member which extends from a respective first rack to a respective second rack, each said arm member including a lower free end that engages said second end of a respective second rack, thereby connecting each of said plurality of first racks to a respective second rack, and whereby each of said second racks is disposed angularly about a longitudinal center line of said main shaft relative to the respective first rack to which it is connected.

2. A digital mark-printer as claimed in claim 1 wherein said central processing unit includes a main control program and further including first and second driver circuits connected to said central processing unit for control by said main control program;

said main shaft driver means connected to said second driver circuit for rotating said main shaft one complete cycle under control of said central processing unit and control program.

3. A digital mark-printer as claimed in claim 2 further including a conveying means located in proximity to said printing head and a conveying driver means connected to said first driver circuit for driving said conveying means and conveying an item into a position to be marked by said printing head under control of said central processing unit and control program.

4. A digital mark-printer as claimed in claim 3 wherein said central processing unit includes a display interface circuit for connection with a monitor; and a printer interface for connection with a printer.

5. A digital mark-printer as claimed in claim 4, wherein said central processing unit includes host interface circuit for connection with a modem and a remote host.

6. A digital mark-printer as claimed in claim 5, wherein said central processing unit includes a keyboard interface circuit for connection with a keyboard.

7. A digital mark-printer as claimed in claim 6, wherein said first driver circuit is connected to an auxiliary driver means;

said second driver circuit is connected to said plurality of wheel driver means and to said main driver means; and further including a driver index interface circuit connected to a plurality of wheel driver indexer means, a main driver indexer means, conveying driver indexer means, and auxiliary driver indexer means.

8. A digital mark-printer as claimed in claim 7, wherein said central processing unit further includes an asynchronous interface circuit means for connection to a payment system.

9. A digital mark-printer as claimed in claim 8, wherein said central processing unit further includes a weighing scale interface circuit means for connection to a weighing scale.

10. A digital mark-printer as claimed in claim 9, wherein:

said conveying driver means includes:

a first belt;

a first pulley;

a second pulley connected to said first pulley by said first belt;

a first stepper motor for driving said first pulley;

a first idle wheel in peripheral contact with said first pulley to provide for frictional conveying force;

a second idle wheel in peripheral contact with said second pulley to provide for frictional conveying force; and said main shaft driver means includes:

a second belt;

a third pulley;

a fourth pulley connected to said third pulley by said second belt and coaxially engaged with said main shaft; and a second stepper motor for driving said third pulley and consequently driving said main shaft to rotate for one cycle and then restore to its home position for a next working cycle.

11. A digital mark-printer as claimed in claim 10 further including a main driver indexer and a conveying driver indexer for sensing the position of the main shaft and conveying means respectively.

12. A digital mark-printer as claimed in claim 11, wherein:

said plurality of wheel driver means each includes a third stepper motor each having a driving gear means engaged with a respective second rack for driving said respective second rack, driving said hook arm of said respective first rack connected to said respective second rack and driving a respective wheel means under control of said central processing unit.

13. A digital mark-printer as claimed in claim 12, wherein said wheel driver means includes a third stepper motor, a corresponding coupler shaft associated with said stepper motor, a screw rod coaxially connected to said coupler shaft, a screw block mounted on said screw rod, a set of solenoid seats installed on said screw block, and a plurality of solenoids disposed on both sides of each of said solenoid seats, said solenoids each having a piston rod which can be extended into or retracted from dents of said second rack for urging said second rack to drive said wheel means under control of said central processing unit, wherein when said second driver circuit activates said third stepper motor to rotate and urge said solenoid seats to move forward via said coupler shaft, screw rod and screw block, whereby said solenoids will extend their piston rod into or retract their piston rod from the dents of said second racks under control of said central processing unit to move said second racks for setting said wheel means to desired positions.

14. A digital mark-printer as claimed in claim 13, further comprising:

a third idle wheel for peripherally contacting said wheel means of said printing head for frictional printing force when said wheel means are positioned and said main shaft is rotated by said main driver means to press said wheel means on conveyed postal material.

15. A digital mark-printer as claimed in claim 14 wherein said main driver indexer means includes a first slotted disk for indicating a home position of said main shaft and said plurality of wheel driver indexer means include a respective plurality of second slotted disks for indicating a home position of said plurality of wheel means.

16. A digital mark-printer as claimed in claim 15 wherein:

said main shaft has a relatively small diameter portion near each of said driving gear means driven by said respective third stepper motors; and said second racks are axially disposed along the periphery of said main shaft in such a manner that said relatively small diameter portion of said main shaft is aligned with the dent bases of said second racks whereby, when said main shaft is rotated, said driving gear means of said respective third stepper motors engaged with said second racks will permit said main shaft to rotate without obstruction.

17. A digital mark-printer as claimed in claim 16, wherein said wheel means, said first racks and said second racks angularly disposed from said first racks are arranged in a square pattern whereby eight wheel means are available for printing.

18. A digital mark-printer as claimed in claim 17, wherein said wheel means, said first racks and said second racks angularly disposed from said first racks are arranged in a right pentagon pattern whereby ten wheel means are available for printing.

19. A digital mark-printer as claimed in claim 18, wherein said wheel means, said first racks and said second racks angularly disposed from said first racks are arranged in a right hexagon pattern whereby twelve numeral wheels are available for printing.

20. A digital mark-printer as claimed in claim 19 including a plurality of guiding bars, each supporting a respective one of said hook arm members so that said arm member can slide;

and wherein each one of said plurality of second racks includes a recess for receiving said lower free end of said hook arm member.

21. A digital mark-printer as claimed in claim 20 including an ink-supplying means comprising:

a pair of ink-supplying roller in peripheral contact with each other, which can contact only protruding numerals of said wheel means;

an adjusting bolt for adjusting a gap between said ink-supplying rollers and said wheel means;

an ink container;

an ink pump;

a solenoid activating said ink pump to transfer ink to said ink-supplying rollers.

22. A digital mark-printer comprising:

a central processing unit for controlling said printer and including a control program;

a weighing scale, a monitor, a payment means, and a parallel bus each being coupled to said central processing unit and under control of said control program;

a sensor circuit and a driver circuit coupled to said central processing unit through said parallel bus, said sensor circuit including a keyboard interface circuit coupled to a keyboard;

said central processing unit being responsive to instructions from said keyboard and weight indicating signals from said weighing scale, said weighing scale being responsive to postal material placed on said scale for displaying said indicated weight on said monitor and for calculating and displaying the required postage on said monitor;

said driver circuit including a first driver circuit coupled to a conveying driver for moving postal material, said central processing unit being responsive to a predetermined postage being received in said payment means for controlling said first driver circuit and said conveying driver to move postal material to a marking position;

a second driver circuit coupled to a plurality of wheel drivers to simultaneously and individually rotate a plurality of numeral wheels coupled to said wheel drivers, said central processing unit controlling said second drier circuit and wheel drivers to rotate said wheels to a position predetermined from said postage paid;

said sensor circuit including a plurality of wheel driver indexers for identifying the location of each of said plurality of numeral wheels, said second driver circuit further coupled to a main driver for rotating a main shaft to imprint numerals from said numeral wheels mounted on said main shaft on said postal material, said central processing unit responsive to said wheel driver indexers for controlling rotation of said main shaft;

said sensor circuit further coupled to a main driver indexer for indicating the position of said main shaft and coupled to said main driver to rotate said main shaft to a home position for a next work cycle; and further including a plurality of gears concentrically attached to said numeral wheels;

a plurality of first racks geared with said plurality of gears, each first rack having an arcuate hook arm member;

a plurality of guiding bars on which said hook arm members slide; and wherein each said arcuate hook arm member extends from a respective first rack to a respective second rack, each said arm member including a lower free end that engages a recess in each said respective second rack, thereby connecting each of said plurality of first racks to a respective second rack, and whereby each of said second racks is disposed angularly about a longitudinal center line of said main shaft relative to the respective first rack to which it is connected.

* * * * *